US006867573B1

(12) United States Patent
Carper

(10) Patent No.: US 6,867,573 B1
(45) Date of Patent: Mar. 15, 2005

(54) TEMPERATURE CALIBRATED OVER-CURRENT PROTECTION CIRCUIT FOR LINEAR VOLTAGE REGULATORS

(75) Inventor: Scott Douglas Carper, Redwood City, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/703,684

(22) Filed: Nov. 7, 2003

(51) Int. Cl.[7] ..... G05F 1/573

(52) U.S. Cl. ..... 323/277; 323/274; 323/315; 361/18

(58) Field of Search ..... 323/373–277, 323/311, 315; 361/18, 93.1, 93.2, 93.8

(56) References Cited

U.S. PATENT DOCUMENTS 5,252,911 A 10/1993 Banura ..... 323/351
5,825,827 A * 10/1998 Troxel et al. ..... 375/296
6,150,714 A 11/2000 Andreyeak et al. ..... 257/690
6,163,202 A 12/2000 Mao ..... 327/513
6,185,082 B1 2/2001 Yang ..... 361/90
6,300,818 B1 10/2001 Mao ..... 327/513
6,329,804 B1 * 12/2001 Mercer ..... 323/315
6,359,427 B1 * 3/2002 Edwards et al. ..... 323/316

* cited by examiner

*Primary Examiner*—Gary L. Laxton
(74) *Attorney, Agent, or Firm*—Brett A. Hertzberg; Merchant & Gould PC

(57) ABSTRACT

An apparatus and method provide for temperature calibrating an over-current limit in a linear regulator. Output current is delivered to the load through a power pass device that is responsive to a gate control signal. A transistor circuit provides a sense current that is proportional to the output current. A diode device senses the operating temperature of the linear regulator. An analog-to-digital converter converts the sensed operating temperature to a digital quantity. A resistance value associated with a resistance circuit is changed in response to the digital quantity. The resistance circuit converts the sense current to a voltage that is compared to a reference voltage. An amplifier is arranged to adjust the gate control signal when the reference voltage is exceeded such that the over-current condition is detected.

20 Claims, 3 Drawing Sheets

TEMPERATURE CALIBRATED OVER-CURRENT PROTECTION CIRCUIT FOR LINEAR VOLTAGE REGULATORS

FIELD OF THE INVENTION

The present invention relates to a system and method for temperature calibrating an over-current limit in a linear regulator. An analog-to-digital conversion technique is applied to dynamically change the current limit in response to changes in operating temperatures of the linear voltage regulator.

BACKGROUND OF THE INVENTION

Voltage regulators are often used to provide a relatively constant voltage source to other electronic circuits. A low drop-out regulator (hereinafter referred to as an "LDO regulator") is a linear voltage regulator that is useful in applications where it is desired to maintain a regulated voltage that is relatively close to the input voltage. For example, LDO regulators are useful in battery-powered applications where the power supply voltage is exceedingly low.

A typical LDO regulator (100) is shown in FIG. 1. The LDO regulator (100) includes a PMOS transistor (P1), a first resistor (R1), a second resistor (R2), an error amplifier (Al), and a reference generator (RGEN). The PMOS transistor (P 1) has a drain that is connected to an output terminal (OUT), a gate that is connected to a control node NC, and a source that is connected to an input voltage (VIN). The first resistor (R1) is series connected between the output terminal (VREG) and a feedback node (NFB). The second resistor (R2) is series connected between node NFB and a circuit ground (GND). The error amplifier (Al) has an input connected to a reverence node (NR), a second input connected to node NFB, and an output connected to node NC. The reference generator has an output that is connected to node NR.

A load (ZL) is connected between the output terminal (OUT) and the circuit ground (GND). The LDO regulator (100) controls the gate of the PMOS transistor (P1) to ensure that regulation of the output voltage (VOUT) is maintained. The error amplifier (A1) monitors a sense voltage (VSNS) at node NFB and controls the gate of the PMOS transistor (P1) by providing a gate control signal (VGATE) at node NC. Resistors R1 and R2 form a resistor divider that produces the sense voltage (VSNS) as a percentage of the output voltage (VOUT). When VSNS and the reference signal (VREF) are substantially the same, the LDO is properly maintaining regulation of the output voltage to the load (ZL).

BRIEF DESCRIPTION OF THE DRAWINGS

Non-limiting and non-exhaustive embodiments of the present invention are described with reference to the following drawings.

DETAILED DESCRIPTION OF THE PREFERRED EMBODIMENT

Figure 1:
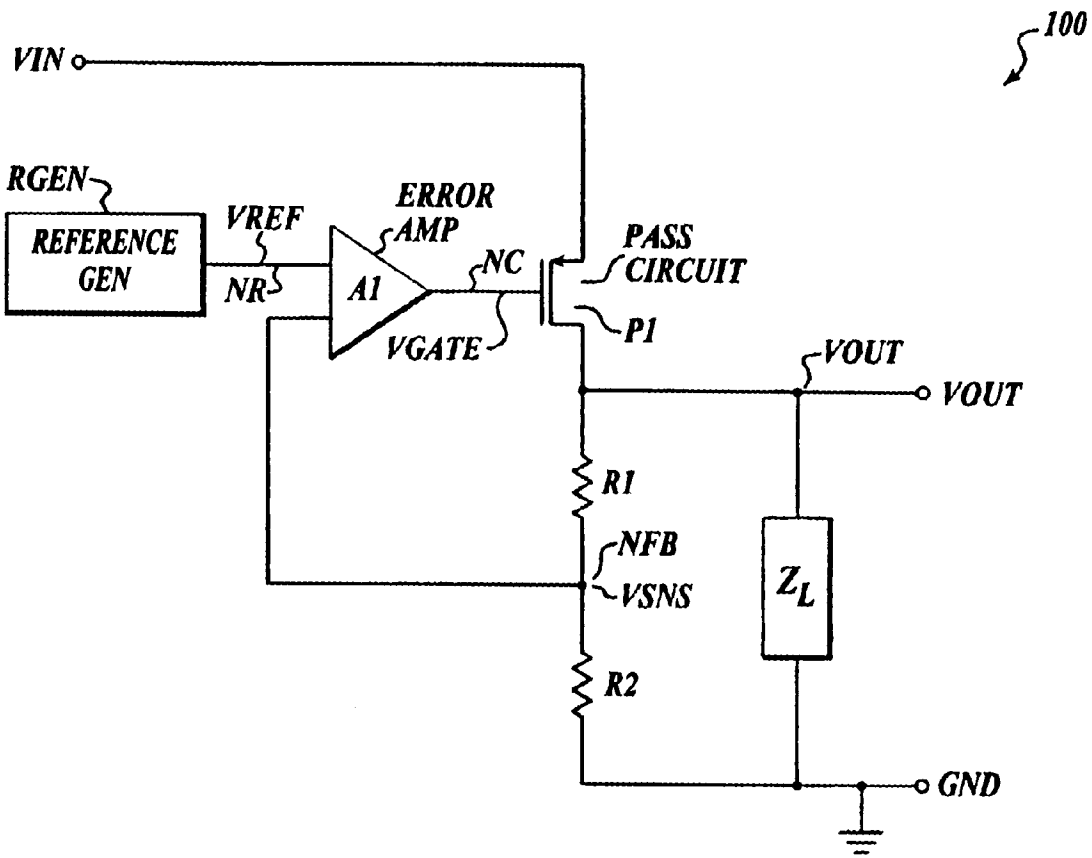
FIGURE 1 (PRIOR ART)
FIG. 1 is an illustration of a conventional linear regulator.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context clearly dictates otherwise. The meanings identified below are not intended to limit the terms, but merely provide illustrative examples for the terms. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected or an indirect connection through one or more passive or active intermediary devices. The term "circuit" means either a single component or a multiplicity of components, either active and/or passive, that are coupled together to provide a desired function. The term "signal" means at least one current, voltage, charge, temperature, data, or other signal.

Briefly stated, the present invention is related to an apparatus and method for temperature calibrating an over-current limit in a linear regulator. Output current is delivered to the load through a power pass device that is responsive to a gate control signal. A transistor circuit provides a sense current that is proportional to the output current. A diode device senses the operating temperature of the linear regulator. An analog-to-digital converter converts the sensed operating temperature to a digital quantity. A resistance value associated with a resistance circuit is changed in response to the digital quantity. The resistance circuit converts the sense current to a voltage that is compared to a reference voltage. An amplifier is arranged to adjust the gate control signal when the reference voltage is exceeded such that the over-current condition is detected.

An over-current protection circuit (OCP) for a CMOS linear voltage regulator is arranged to limit the channel current in the shunt device to a safe level when the device is subject to an output short circuit condition. Most OCP circuits in CMOS designs exhibit a severe dependence on die temperature and also require more than two cell voltages to operate. The present invention is arranged to provide over-current protection that has reduced dependency on the die temperature while operating with a single input voltage.

The present invention provides a thermal shutdown circuit that is included on the same die as an integrated circuit (I.C.) based linear voltage regulators. The "on-die" or "on-chip" thermal shutdown circuit includes a temperature dependent voltage source that is configured to turn off the power pass element when the die temperature has exceeded the targeted thermal shutdown threshold (e.g., 150° C. to 170° C. depending on the design). The OCP circuit of the present invention utilizes a temperature dependent voltage source from the temperature shut-down (TSD) circuit as the analog input of a simple analog-to-digital converter (ADC). An output signal from the ADC is applied to the OCP architecture to digitally adjust the threshold of the current-limit "n-times" over multiple ranges of junction temperatures. The larger the value of "n" the tighter the current limit threshold is over temperature.

The OCP circuit of the present invention uses a current-to-voltage (I-V) converter. A small sense transistor of the same type as the power pass element is arranged in a common gate and common source configuration. The drain of the pass element is coupled to the output terminal of the regulator, while the small sense transistor's drain is configured to produce a small sense current that is proportional to the output load current. The sense current is coupled to either a resistor or a diode connected metal oxide semiconductor transistor (MOST) to provide a sense voltage, which completes the I-V conversion. A comparator or amplifier can be used to evaluate the sense voltage and either shut down the power pass element or regulate the gate terminal of the power pass element when the designed value of overload current has been exceeded.

Resistors and MOST have a very strong dependence on temperature and that potentially can cause unacceptably large temperature dependent variations in the current limit threshold. The large temperature coefficient in the current limit circuit may result in costly solutions in the end product to preserve functionality over a wide range of conditions. For example, the circuit designer may be required to choose a larger number of bond pads, more costly bond wires, or additional bond wires on each bond pad to prevent the bond wires from fusing during an overload current condition. The end result is that additional bond wires and additional pads are required to satisfy reliability standards for the entire junction temperature range of the product (typically from −40° C. to +125° C. As the maximum rated current in linear regulators begins to increase above 1 Amp, additional bonding pads and bonding wires becomes more critical resulting in increased manufacturing costs.

Other circuit techniques have been attempted to help compensate for the large temperature coefficient in the OCP circuit without satisfactory results (e.g., requiring higher supply voltages). The present invention includes a temperature calibration technique that can operate without requiring increased supply voltages, and with voltage thresholds (VTs) in the range of 800 mV.

Figure 2:
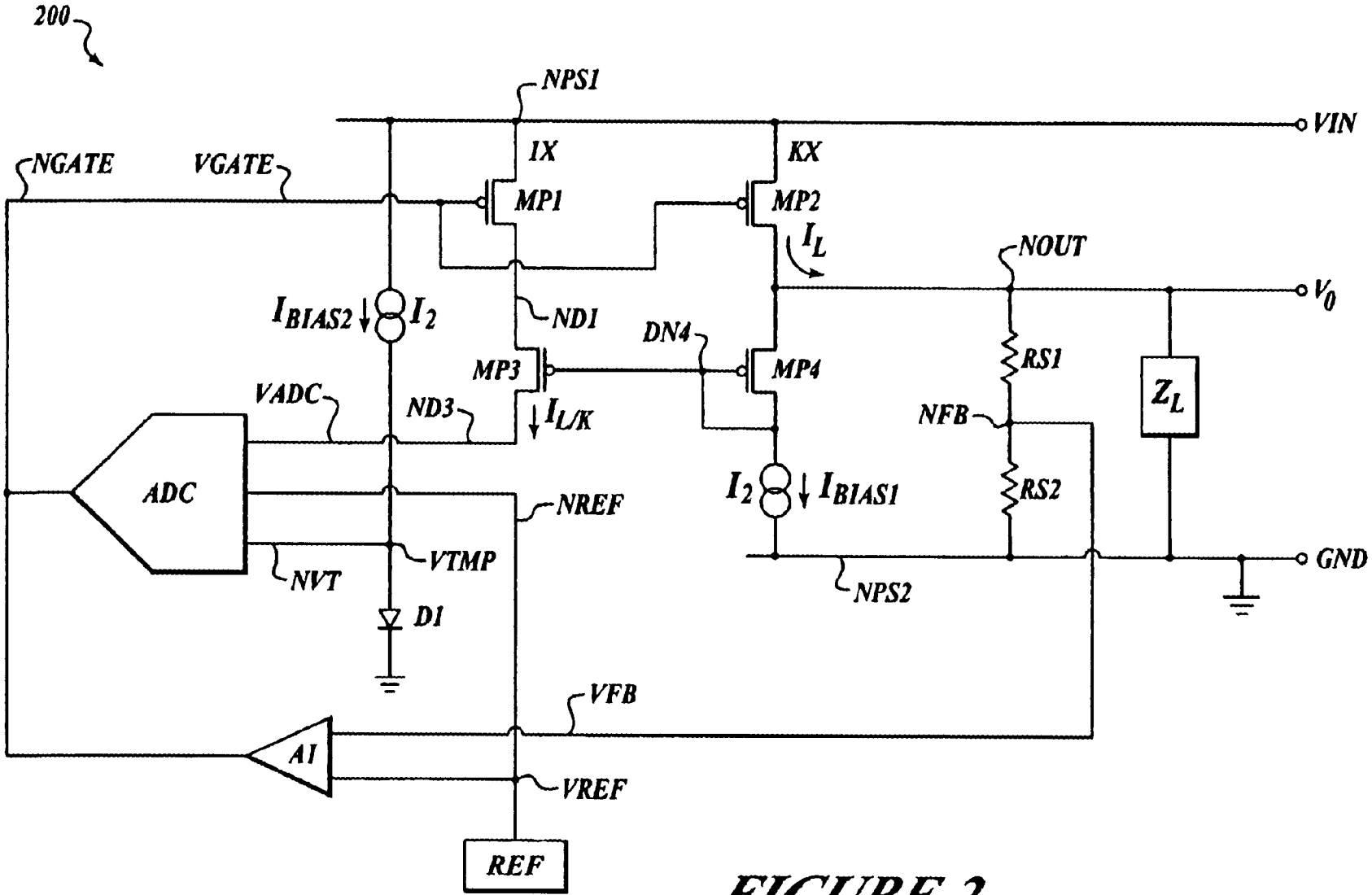
FIG. 2 is an illustration of an example linear regulator circuit with temperature compensated over-current protection.

FIG. 2 is an illustration of an example linear regulator (200) that includes an OCP circuit that is arranged according to an embodiment of the present invention. The circuit (200) includes: four p-type transistors ($MP_1$ –$MP_4$), a diode (D1), two current sources ($I_1$, $I_2$), a reference circuit (REF), two resistors ($RS_1$, $RS_2$), an amplifier (A1), and analog-to-digital converter (ADC) circuit, and a load circuit ($Z_L$).

Transistor $MP_1$ includes a source that is coupled to node NPS1, a gate that is coupled to node NGATE, and a drain that is coupled to node ND1. Transistor $MP_2$ includes a source that is coupled to node NPS1, a gate that is coupled to node NGATE, and a drain that is coupled to node NOUT. Transistor $MP_3$ includes a source that is coupled to node NDI, a gate that is coupled to node ND4, and a drain that is coupled to node ND3. Transistor MP4 includes a source that is coupled to node NOUT, a gate that is coupled to node ND4, and a drain that is coupled to node ND4. Current source $I_1$ is coupled between nodes ND4 and NPS2. Current source $I_2$ is coupled between nodes NPS1 and NVT. Resistor $RS_1$ is coupled between node NOUT and node NFB. Resistor $RS_2$ is coupled between node NF and node NPS2. Load circuit $Z_L$ is coupled between node NOUT and node NPS2. Reference circuit REF is coupled to node NREF. Diode $D_1$ is coupled between node NVT and node NPS2. Amplifier A1 includes a first input that is coupled to node NFB, a second input that is coupled to node NREF, and an output that is coupled to node NGATE. The ADC circuit includes an output that is coupled to node NGATE, a first input that is coupled to node NREF, a second input that is coupled to node NVT, and a third input that is coupled to node ND3.

In operation, an input power signal (VIN) is applied across nodes NPS1 and NPS2. The linear regulator circuit (200) is configured to supply current ($I_L$) to the load circuit ($Z_L$) via transistor MPG, which is a power-type pass transistor. The load circuit ($Z_L$) develops a voltage ($V_O$) at node NOUT. Resistors $RS_1$ and $RS_2$ are arranged to operate as an output sense circuit that provides a feedback signal ($V_{FB}$) at node NFB in response to the output voltage ($V_O$). Although the output sense circuit is illustrated as a resistor divider network, other circuits can be arranged to provide output sensing without departing from the spirit of the present invention.

Reference circuit REF is arranged to provide a reference signal ($V_{REF}$) at node NREF. In one example, the reference circuit is a band-gap reference circuit. Amplifier A1 is configured to operate as an error amplifier that compares the feedback signal to the reference signal ($V_{REF}$) to provide a control signal ($V_{GATE}$) at node NGATE. Transistors $MP_1$ and $MP_2$ are responsive to the control signal ($V_{GATE}$), closing the feedback control loop in the linear regulator.

Transistor $MP_3$ is configured to operate as a cascode transistor in series with transistor $MP_1$. Transistor $MP_3$ is biased in common with transistor $MP_4$, where transistor $MP_4$ is configured to operate as a diode that is biased by a current ($I_{BIAS1}$) from current source $I_1$. Transistors $MP_1$ and $MP_2$ are sized relative to one another according to a ratio (K) such that transistor $MP_1$ has a drain current ($I_{D1}$) that corresponds to IL/K.

The ADC circuit is arranged to sense the output current ($I_L$), sense the operating temperature of the circuit, and provide an over-current protection function. In one example, the control signal ($V_{GATE}$) is decreased by the output of the ADC to prevent excessive output currents during a fault. In another example, the control signal ($V_{GATE}$) is coupled to node $N_{PS1}$ by the output of the ADC to deactivate transistor MP2 (the power pass device) in response to the fault. Possible fault conditions include a short circuit on the output, an over-temperature condition, as well as others.

The output of the ADC circuit and amplifier $A_1$ are arranged to cooperate with one another to accommodate the over-current protection function. In one example, amplifier A1 is arranged with a weak output stage so that the ADC circuit can override the control signal level when the fault condition is detected. In another example, the ADC circuit includes a large pull-up device that is arranged to couple node VGATE to node NPS1 when the fault condition is detected.

An on-chip temperature sensor is illustrated by diode $D_1$, which is biased by a current ($I_{BIAS2}$) that is provides by current source $I_2$ The on-chip temperature sensor is arranged to provide a voltage ($V_{TMP}$) at node NVT, where voltage $V_{TMP}$ is proportional to the die temperature. For example, diode D1 has a nominal value of 600 mV at a temperature of 25° C., with a temperature coefficient of −2 mV/° C.

The ADC circuit senses the output current (IL) by converting the drain current ($I_{D1}$) of transistor $MP_1$ into a voltage ($V_{ADC}$). Current $I_{DI}$ is coupled into the ADC circuit, which converts current $I_{D1}$ into a voltage ($V_{ADC}$) through an adjustable resistance (e.g., see FIG. 3). The ADC circuit controls the amount of the resistance in response to the sensed temperature. The over-current protection mechanism is activated when voltage $V_{ADC}$ exceeds the reference voltage $V_{REF}$. Since $V_{ADC}$ is responsive to the sensed temperature, the current limit is effectively adjusted in response to the sensed temperature.

Figure 3:
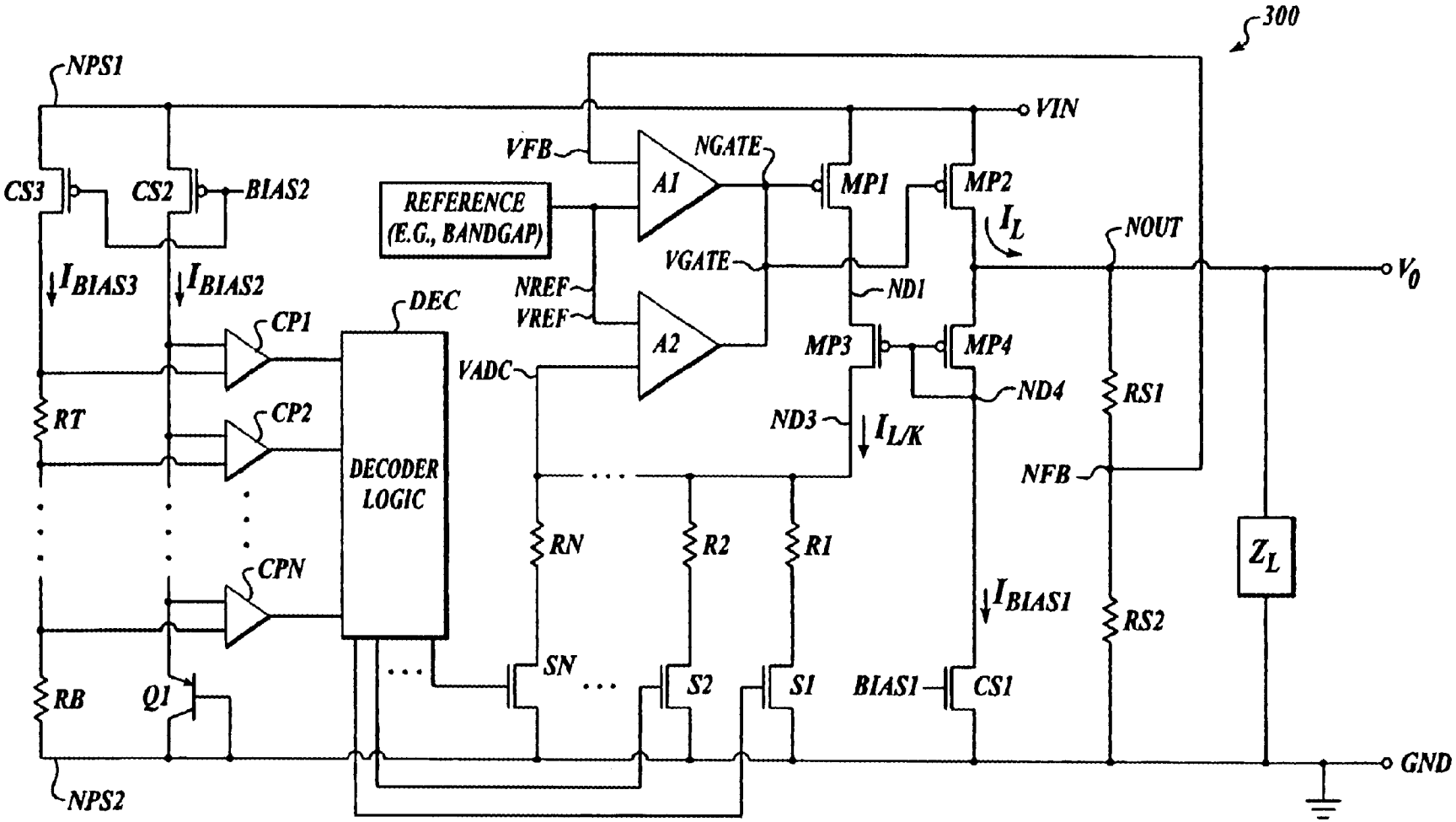
FIG. 3 is an illustration of another example linear regulator circuit with temperature compensated over-current protection, arranged in accordance with an embodiment of the present invention.

FIG. 3 is an illustration of another example linear regulator (300) that includes an OCP circuit that is arranged according to another embodiment of the present invention. The circuit (300) includes: four p-type transistors ($MP_1$–$MP_4$), a diode configured bipolar junction transistor ($Q_1$), two current sources ($I_1$, $I_2$), a reference circuit (REF), two resistors ($RS_1$, $RS_2$), an amplifier ($A_1$), a load circuit ($Z_L$), and an analog-to-digital converter (ADC) circuit. Circuit 300 is arranged in substantially the same configuration as circuit 200, with additional details illustrating an example ADC circuit.

The ADC circuit includes an amplifier ($A_2$), a current sources ($CS_3$), an array of comparators ($CP_1$–$CP_N$), a decoder logic (DEC) circuit, a first set of resistors ($R_B$–$R_T$), a second set of resistors ($R_1$–$R_N$), and a set of switches ($S_1$–$S_N$). Current source $CS_1$ is illustrated as an n-type MOS transistor, while current sources $CS_2$ and $CS_3$ are illustrated as p-type MOS transistors. Switches $S_1$–$S_N$ are illustrated as n-type MOS transistors.

Current source CS3 is arranged to drive a current (IBIAS3) through the first set of resistors (RB–RT), which are series coupled to one another as illustrated in FIG. 3. Each of the first set of resistors is generally arranged to provide a reference voltage level for a corresponding one of the comparators ($CP_1$–$CP_N$). Each of the comparators ($CP_1$–$CP_N$) is arranged to compare the corresponding reference voltage level to voltage $V_{TMP}$ and provides a control signal.

In one example, current source CS3 is biased by a current related to a band-gap circuit. The resistors in the band-gap circuit should be made of the same materials as resistors $R_B$1–$R_T$ such that the temperature coefficients of resistors $R_B$–$R_T$ are cancelled, and the reference voltage levels for comparators $CP_1$–$CP_N$ are temperature stabilized.

Transistor $Q_1$ is arranged to provide a voltage ($V_{TMP}$) that is proportional to temperature. Resistors $R_1$–$R_N$ are arranged in cooperation with switches $S_1$–$S_N$ such that each of the resistors ($R_1$–$R_N$) is selectively coupled between node ND3 and node NPS2. The decoder logic circuit is arranged to selectively control switches ($S_1$–$S_N$) in response to the various control signals from comparators $CP_1$–$CP_N$. Voltage $V_{ADC}$ is determined by the total effective resistance between nodes ND3 and NPS2, which is determined by the parallel combination of selected resistor values such that: $V_{ADC}=I_L*(R_1*b_1 \| R_2*b_2 \ldots \| R_N*b_N)/K$, where variables $b_1$ –$b_N$ correspond to the logical control bit associated with activation of switches $S_1$–$S_N$. Amplifier A2 is arranged to compare the $V_{REF}$ to $V_{ADC}$ to provide over-current protection to the circuit.

Amplifiers $A_1$ and $A_2$ are arranged to cooperate with one another to provide an appropriate control signal ($V_{GATE}$) at node NGATE.

In one example, resistors $R_1$–$R_N$ are equally in value and the effective resistance is adjusted by selecting the parallel combination of resistors. In another example, resistors $R_1$–$R_N$ are non-equal in value such as a binary weighting of their values. The individual resistance values for resistors R1 through RN may also be related to one another as any other set of resistance values that are either uniformly or non-uniformly spaced in values as may be desired. In a simplest example, the decoder logic circuit corresponds to wired connections from the output of each of the comparators to a respective switch. In general terms, the decoder logic circuit is arranged to selectively activate a predetermined selection of switches based on the comparators output signals. The switches and resistance can be arranged to cooperate with the decoder logic circuit such that the resistors can be individually selected, series combined resistors, parallel combined resistors, or some other combination of resistors to adjust the effective resistance value in response to the sensed temperature.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An apparatus for sensing an over-current condition in a linear regulator that is arranged to provide an output current to a load circuit from a power pass device, the apparatus comprising:

a transistor circuit that is arranged to provide a sense current that is proportional to the output current;

a temperature sense circuit that is arranged to provide a temperature signal that is proportional the operating temperature of the linear regulator;

an analog-to-digital converter circuit that is arranged to provide a control signal in response to the temperature signal and a reference signal;

an adjustable resistance circuit that is arranged to provide a sense voltage in response to the sense current, wherein the adjustable resistance circuit is configured to adjust an effective resistance associated with the adjustable resistance circuit in response to the control signal from the analog-to-digital converter; and an amplifier circuit that is arranged to change a gate control signal to the power pass device in response to the sense voltage such that the output current is changed when the sense voltage reaches a level that corresponds to the reference voltage, whereby the apparatus provides over-current protection to the linear regulator when the sense voltage reaches a level that corresponds to the reference voltage.

2. The apparatus of claim 1, further comprising a reference circuit that is arranged to provide the reference signal.

3. The apparatus of claim 1, further comprising a band-gap reference circuit that is arranged to provide the reference signal as a temperature compensated voltage.

4. The apparatus of claim 1, wherein the transistor circuit includes a first transistor that is arranged in a common gate configuration with the power pass device.

5. The apparatus of claim 4, further comprising a second transistor that has a source that is coupled to the drain of the first transistor, a gate that is biased to operate as a cascode device, and a drain that is coupled to the adjustable resistance circuit.

6. The apparatus of claim 1, the temperature sense circuit comprising a current source that is series coupled to a diode such that the diode provides a temperature signal as a voltage that is proportional to the temperature associated with the diode.

7. The apparatus of claim 6, wherein the current source is biased by a bias signal from a band-gap circuit such that the current source provides a current that is relatively invariant to changes in operating temperature.

8. The apparatus of claim 1, wherein the analog-to-digital converter comprises a set of comparators and a decoder logic circuit, wherein each comparator is arranged to compare the temperature signal to a corresponding reference level, and wherein the decoder logic circuit is arranged to provide the control signal to the adjustable resistance circuit in response to output signals from the comparators.

9. The apparatus of claim 8, wherein the reference levels are provided by a current source that provides a bias current to a set of resistors such that each of the resistors provide a different one of the reference levels.

10. The apparatus of claim 9, wherein the set of resistors are made of a resistance material that is matched to a band-gap circuit, wherein the band-gap circuit is arranged to bias the current source such that the reference levels are relatively invariant to changes in operating temperature.

11. The apparatus of claim 1, wherein the adjustable resistance circuit comprises a set of resistors and a set of switch circuits, wherein each of the resistors is selectively coupled to the transistor circuit through a corresponding one of the switch circuits, wherein the switch circuits are responsive to the control signal such that the effective resistance associated with the adjustable resistance circuit is responsive to the control signal.

12. The apparatus of claim 1, wherein the amplifier means is arranged to disable the power pass device when the output current level exceeds a threshold that is determined by the operating temperature of the linear regulator.

13. The apparatus of claim 1, wherein the amplifier means is arranged to reduce the output current from the power pass device when the output current level exceeds a threshold that is determined by the operating temperature of the linear regulator.

14. An apparatus for sensing an over-current condition in a linear regulator that is arranged to provide an output current to a load circuit from a power pass device, the apparatus comprising:

a sense means that is arranged to provide a sense current that is proportional to the output current from the power pass device;

a temperature sense means that is arranged to provide a temperature signal that is proportional the operating temperature of the linear regulator;

an analog-to-digital converter means that is arranged to provide a digital control signal in response to the temperature signal;

an adjustable resistance means that is arranged to provide a sense voltage in response to the sense current, wherein the adjustable resistance means is configured to adjust an effective resistance associated with the adjustable resistance means in response to the digital control signal; and a control means that is arranged to change a gate control signal to the power pass device in response to the sense voltage such that the output current is reduced when the sense voltage exceeds an over-current level that is related to the operating temperature of the linear regulator.

15. An apparatus for regulating an output voltage across a load circuit, the apparatus comprising:

a first transistor that is arranged to provide an output current to the load circuit in response to a gate control signal;

a transistor circuit that is arranged to provide a sense current that is proportional to the output current, wherein the transistor circuit is responsive to the gate control signal;

a temperature sense circuit that is arranged to provide a temperature signal that is proportional to the operating temperature of the apparatus;

an analog-to-digital converter circuit that is arranged to provide a control signal in response to the temperature signal and a reference signal;

an adjustable resistance circuit that is arranged to provide a sense voltage in response to the sense current, wherein the adjustable resistance circuit is configured to adjust an effective resistance associated with the adjustable resistance circuit in response to the control signal from the analog-to-digital converter;

a feedback circuit that is arranged to provide a feedback voltage that is proportional to the output voltage;

a first amplifier circuit that is arranged to adjust the gate control signal in response to the feedback voltage and the reference signal when the apparatus is in a non-fault condition; and a second amplifier circuit that is arranged to change the gate control signal in response to the sense voltage and the reference voltage when the apparatus is in a fault condition, wherein the apparatus is in a fault condition when the output current exceeds a threshold that is adjusted in response to the operating temperature of the apparatus via the cooperation of the analog-to-digital converter circuit, and the adjustable resistance circuit.

16. The apparatus of claim 15, wherein the feedback circuit corresponds to a resistor divider circuit that is coupled to the load circuit.

17. The apparatus of claim 15, further comprising a band-gap reference circuit that is arranged to provide the reference signal as a temperature compensated voltage.

18. The apparatus of claim 15, wherein the transistor circuit comprises a second transistor, a third transistor, a fourth transistor, and a current source, wherein: the first transistor is arranged in a common gate and common source configuration with the second transistor, the third transistor is arranged to operate as a diode that is biased by the current source, and the fourth transistor is biased by the third transistor and arranged to operate as a cascode for the second transistor.

19. The apparatus of claim 15, wherein the second amplifier circuit is arranged to disable the first transistor when the output current level exceeds a threshold that is determined by an operating temperature of the apparatus as sensed by the cooperation of the analog-to-digital converter circuit, the adjustable resistance circuit, and the second amplifier circuit.

20. A method for sensing an over-current condition in a linear regulator that is arranged to provide an output current to a load circuit from a power pass device, the method comprising:

sensing the output current from the power pass device;

sensing the operating temperature of the linear regulator;

converting the sensed operating temperature to a digital quantity;

adjusting a resistance value associated with a resistance circuit in response to the digital quantity;

converting the sense current to a sense voltage with the resistance circuit; and changing a gate control signal for the power pass device in response to the sense voltage such that the output current is reduced when the sense voltage exceeds an over-current level that is related to the operating temperature of the linear regulator.

* * * * *

UNITED STATES PATENT AND TRADEMARK OFFICE

CERTIFICATE OF CORRECTION

PATENT NO. : 6,867,573 B1
DATED : March 15, 2005
INVENTOR(S) : Scott Douglas Carper It is certified that error appears in the above-identified patent and that said Letters Patent is hereby corrected as shown below:

Column 6,
Line 18, "signal that is proportional the" should read
-- signal that is proportional to the --.

Column 7,
Line 33, "signal that is proportional the" should read
-- signal that is proportional to the --.

Signed and Sealed this

Thirtieth Day of August, 2005

JON W. DUDAS
*Director of the United States Patent and Trademark Office*